US009771088B2

(12) United States Patent
Goding

(10) Patent No.: US 9,771,088 B2
(45) Date of Patent: Sep. 26, 2017

(54) LOCOMOTIVE TRUCK STEERING SYSTEM

(71) Applicant: Electro-Motive Diesel, Inc., LaGrange, IL (US)

(72) Inventor: David J. Goding, Bridgman, MI (US)

(73) Assignee: Electro-Motive Diesel, Inc., LaGrange, IL (US)

( * ) Notice: Subject to any disclaimer, the term of this patent is extended or adjusted under 35 U.S.C. 154(b) by 196 days.

(21) Appl. No.: 14/711,490

(22) Filed: May 13, 2015

(65) Prior Publication Data

US 2016/0332643 A1 Nov. 17, 2016

(51) Int. Cl.
*B61F 5/38* (2006.01)

(52) U.S. Cl.
CPC ..... *B61F 5/38* (2013.01)

(58) Field of Classification Search
CPC ..... B61F 5/38; B61F 5/44; B61F 5/32; B61F 15/00; B61F 3/06; B61F 5/24; B61F 5/46; B61F 15/08
USPC .... 105/165, 166, 167, 168, 169, 170, 218.1, 105/218.2, 222, 223
See application file for complete search history.

(56) References Cited

U.S. PATENT DOCUMENTS

| | | | | |
|---|---|---|---|---|
| 4,765,250 | A | 8/1988 | Goding | |
| 4,889,054 | A | 12/1989 | List | |
| 5,613,444 | A | 3/1997 | Ahmadian et al. | |
| 6,006,674 | A * | 12/1999 | Ahmadian | B61F 5/38 105/220 |
| 6,871,598 | B2 | 3/2005 | Schaller et al. | |
| 6,910,426 | B2 | 6/2005 | Krishnaswami | |
| 7,007,611 | B2 | 3/2006 | Auer | |
| 7,066,095 | B2 | 6/2006 | Augsburg et al. | |
| 8,701,564 | B2 | 4/2014 | Schaller et al. | |
| 2004/0221763 | A1* | 11/2004 | Wike | B61F 5/44 105/167 |
| 2013/0312634 | A1 | 11/2013 | Smit | |

FOREIGN PATENT DOCUMENTS

| | | |
|---|---|---|
| EP | 0387744 A2 | 9/1990 |

* cited by examiner

*Primary Examiner* — Mark Le
(74) *Attorney, Agent, or Firm* — Miller, Matthias & Hull LLP

(57) ABSTRACT

A steering system for a locomotive truck may include a first axle and a plurality of primary bearing adapter assemblies, each primary bearing adapter assembly may include a bearing adapter and a swiveling back plate, wherein each bearing adapter may be disposed around the first axle.

13 Claims, 9 Drawing Sheets

LOCOMOTIVE TRUCK STEERING SYSTEM

TECHNICAL FIELD

This disclosure generally relates to locomotive trucks, and more particularly, relates to a locomotive truck steering system.

BACKGROUND

Rail transportation is commonly used to move people and cargo. Trains of wheeled vehicles often provide a more efficient and timely means of travel than other forms of transportation. Material can be moved solely via rail, or can use rail transportation as a segment within an inter-modal system. Trains generally travel on one or more rails, but can also use other stabilization and directional devices, including electromagnetics.

Trains are powered by one or more locomotives or powered cars, and are usually controlled by an operator. The operator is generally present on board the train, although other arrangements are possible. Propulsion can be provided by a variety of on-board motors, including reciprocating engines, turbines, electric motors, diesel-electric systems or electromagnetic systems. The energy source can be carried on board the train in the form of fuel or battery power. Alternatively, the train can draw power from an external system, such as overhead power lines or an additional electrified rail near ground level.

The operator may control the train by manipulating manual controls or issuing vocal or electronic signals in a cab or a remote location. Trains may have a manual control mode where the train can directly respond to operator inputs regarding commands for applied throttle or other systems. Such a manual control mode may receive operator commands through a hand throttle, or other manual control. The operator may be located within the locomotive, or remotely relative to the locomotive.

As a locomotive operates, it may pull the train along curved track sections. The locomotive may provide tractive power by powering wheels attached to trucks or bogies provided at the bottom of the locomotive. Each truck may have more than one axle, and each axle may include two wheels. As the locomotive negotiates a curved track section, the trucks may pivot relative to the orientation of the locomotive. In a traditional truck arrangement, each axle within each truck may pivot to the same degree as the truck. However, allowing leading and trailing axles to radially steer within each bogie provides efficiency and tractive benefits.

Ahmadian (U.S. Pat. No. 6,006,674) discloses a "Self-Steering Railway Truck." Ahmadian describes a system for coordinating yaw angles between leading and trailing axles. However, the described system may not operate in conjunction with existing trucks, including those with pedestals. Further, the system described in Ahmadian incorporates a connection between the leading and trailing axles, adding weight, costs and complexity.

Accordingly, there is a need for an improved steering system for a locomotive truck.

SUMMARY OF THE DISCLOSURE

In one aspect, a steering system for a locomotive truck is disclosed. The steering system may include a first axle and a plurality of primary bearing adapter assemblies, each bearing adapter assembly may include a bearing adapter and a swiveling back plate, wherein each bearing adapter may be disposed around the first axle.

In another aspect, a locomotive truck is disclosed. The locomotive truck may include a frame, a first axle supported by the frame, and a plurality of bearing adapter assemblies, each bearing adapter assembly may include a bearing adapter and a swiveling back plate, wherein each bearing adapter may be disposed around the first axle.

In another aspect, a method for radially steering a first axle of a locomotive truck is disclosed. The method may include providing a first axle, positioning the first axle within a plurality of primary bearing adapter assemblies, each bearing adapter assembly including a bearing adapter and a swiveling back plate, wherein each bearing adapter is disposed around the first axle, and linking the bearing adapters through a mechanical linkage, wherein the mechanical linkage enables each bearing adapter to rotate by the same degree, and in the same direction, relative to each respective swiveling back plate.

These, and other aspects and features of the present disclosure, will be better understood upon reading the following detailed description when taken in conjunction with the accompanying drawings.

DETAILED DESCRIPTION

Figure 1:
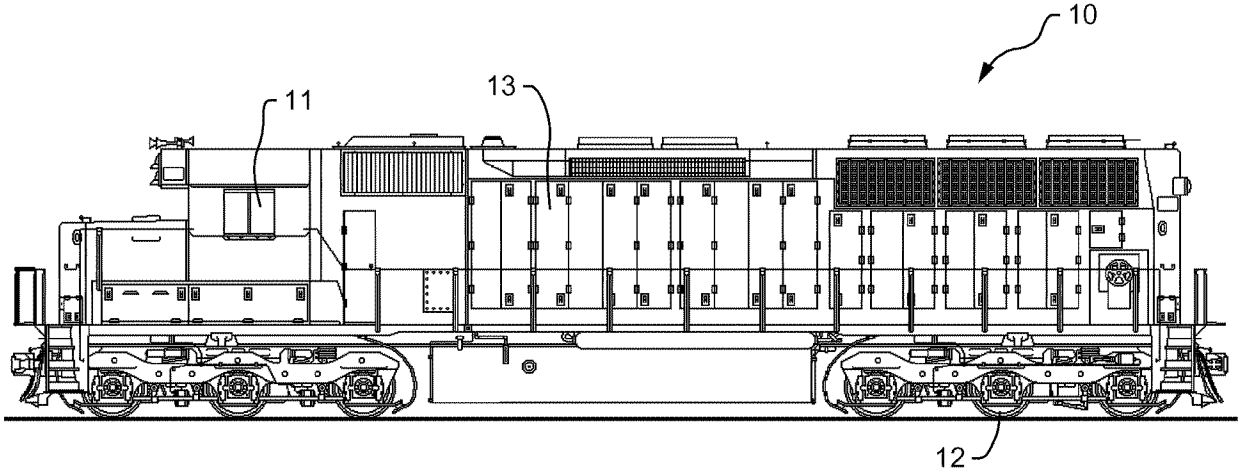
FIG. 1 is a schematic side view of a locomotive constructed in accordance with the present disclosure.
Figure 2:
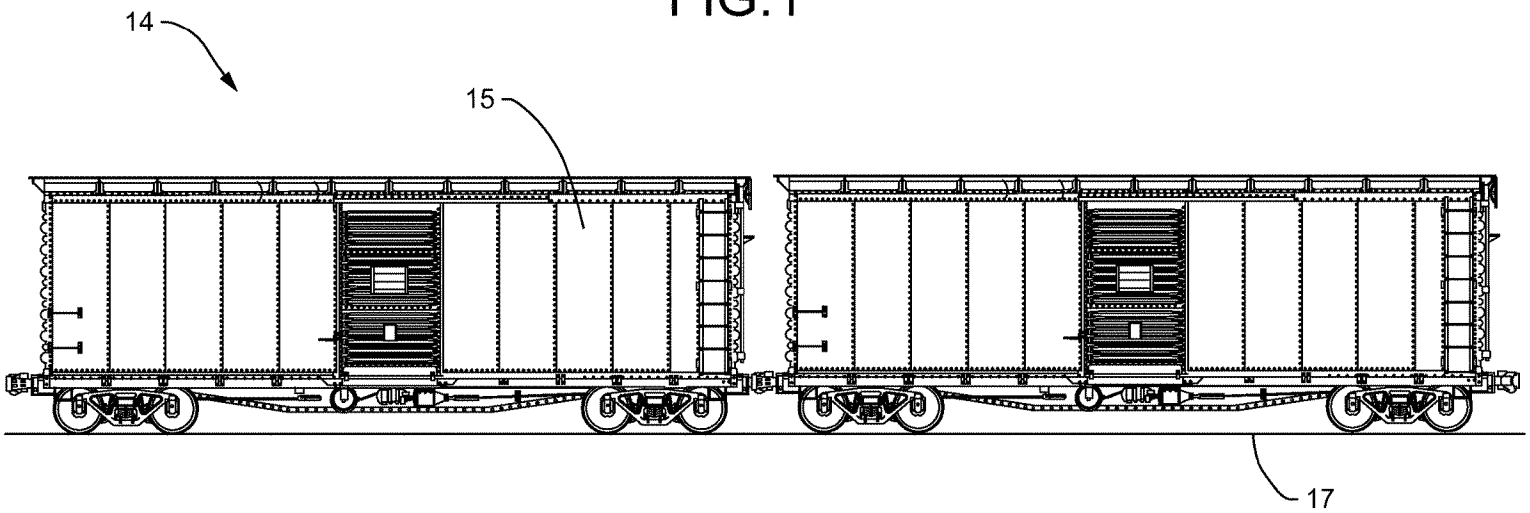
FIG. 2 is a schematic side view of a train including a number of cars constructed in accordance with the present disclosure.

Referring now to the drawings, and with specific reference to FIG. 1, a locomotive constructed in accordance with the present disclosure is generally referred to by reference numeral 10. The locomotive 10 may include a cab 11, a plurality of wheels 12 and an engine 13. The locomotive 10 may pull a train 14 consisting of a variety of cars 15 along one or more rails 17, as shown in FIG. 2. The engine 13 may consist of one or more reciprocating engines, turbines, electric motors or electromagnetic systems. A fuel or energy source can be carried on board the train 14 in the form of fuel or battery power, or can be positioned along the rails 17.

The locomotive 10 may power one or more of the wheels 12 in contact with the one or more rails 17, propelling the train 14 along the rail 17. One or more rails 17 may also be known as a track. An operator may be located within the cab 11, train 14 or remotely relative to the train 14 in a remote operator station. The operator may issue commands to influence the performance of the train 14.

Figure 3:
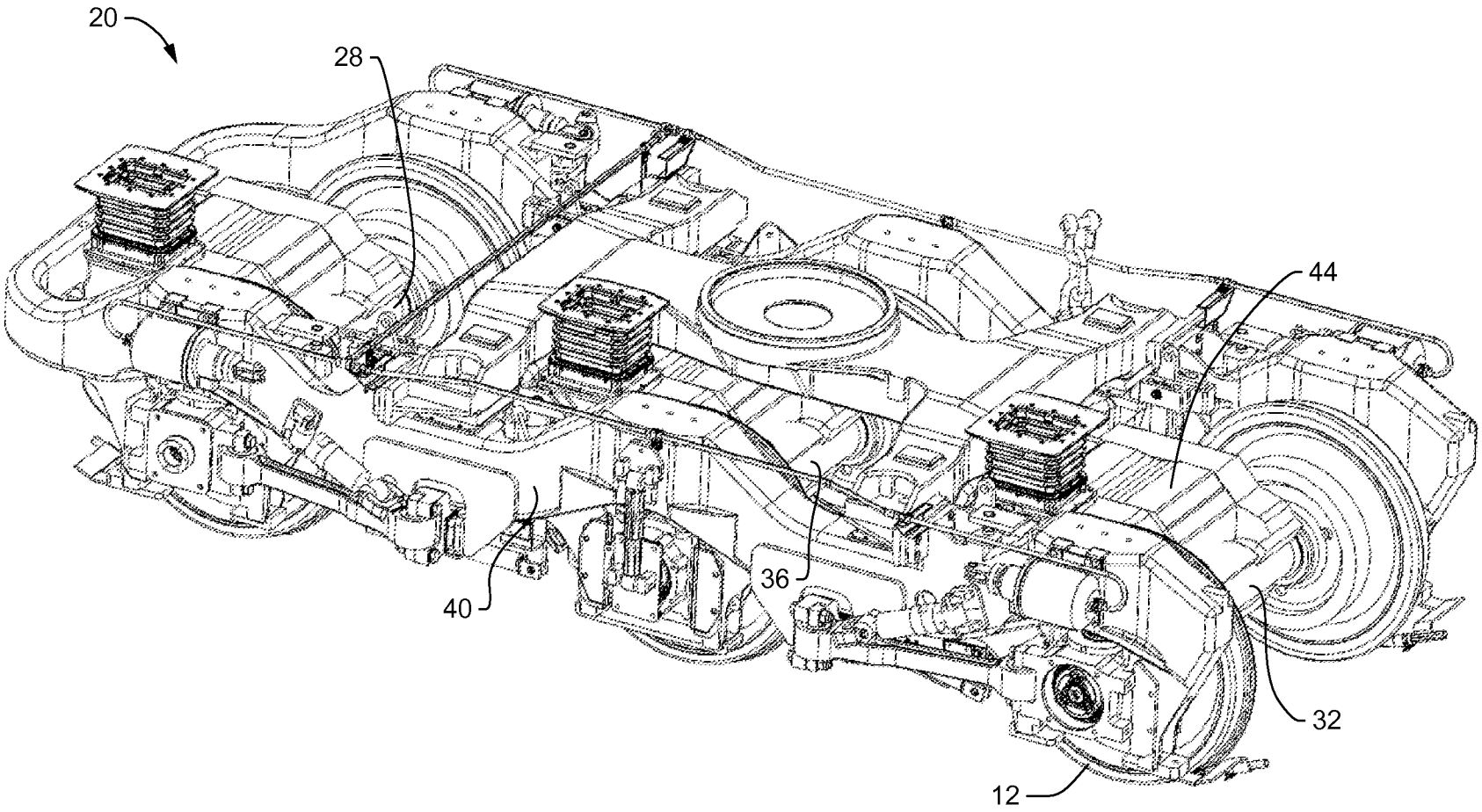
FIG. 3 is a perspective view of a truck constructed in accordance with the present disclosure.

Turning to FIG. 3, a truck 20 (also referred to herein as a "bogie") is a structure that may be supported by a first axle 28 and a secondary axle 32, and the locomotive 10 may be supported by one or more trucks 20. The truck 20 may also be known as a locomotive truck. Further, the truck 20 may pivot relative to the orientation of the locomotive 10 as the locomotive 10 negotiates a curved section of rail 17. The truck 20 may further include an intermediate axle 36 disposed between the first 28 and secondary 32 axles.

The truck 20 further includes a frame 40 supporting the locomotive 10 and transmitting the locomotive 10 weight to the wheels 12. One or more axles 28, 32, 36 may be powered by a traction motor 44. The traction motors 44 may be powered by the engine 13 and may mechanically rotate an axle 28, 32, 36 or a wheel 12.

Figure 4:
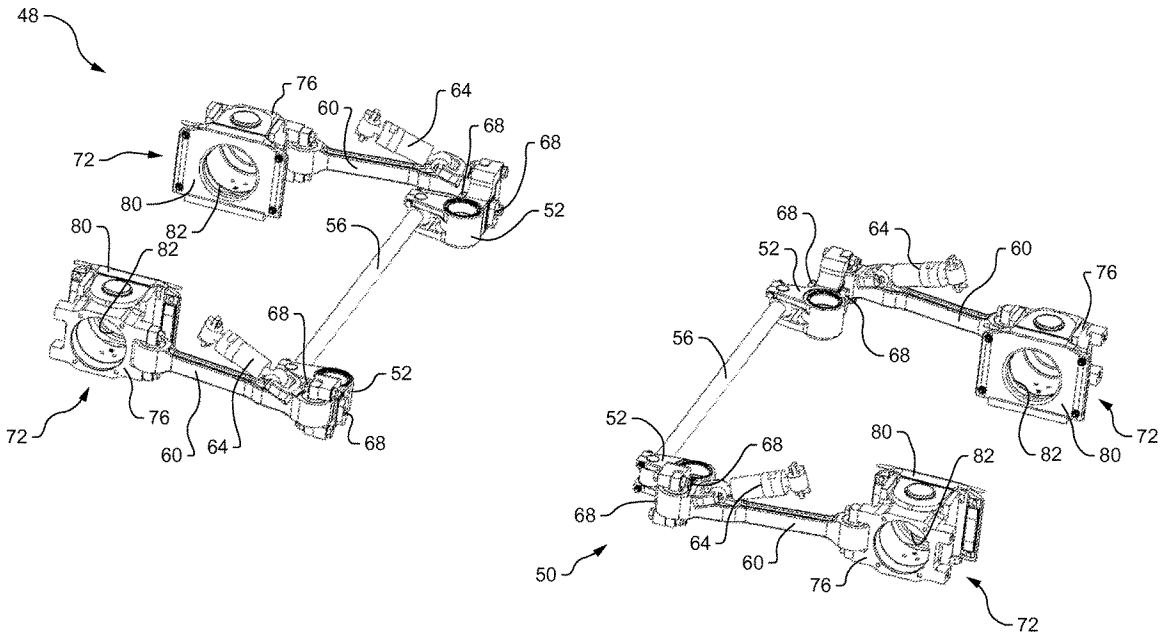
FIG. 4 is a perspective view of a steering system constructed in accordance with the present disclosure.

Turning now to FIG. 4, a steering system 48 is shown. The steering system 48 may comprise a mechanical linkage 50 which may include a bellcrank 52, crosslink 56, traction rod 60 and a yaw damper 64. In an embodiment, the mechanical linkage 50 may include four bellcranks 52, two crosslinks 56, four traction rods 60 and four yaw dampers 64. Each bellcrank 52 may include one or more bellcrank bumpers 68, which may be composed of a polymer and may designed to dimensionally compress when placed in compression.

FIG. 4 also shows a bearing adapter assembly 72. The bearing adapter assembly 72 may include a bearing adapter 76 and a swiveling back plate 80. The swiveling back plate 80 may include a clearance hole 82. An axle 28, 32 may be disposed within the bearing adapter 76 and load from the locomotive 10 may travel through the bearing adapter 76 to the axle 28, 32. The bearing adapter 76 may also provide for the rotation of the axle 28, 32 while the bearing adapter 76 is disposed around the axle 28, 32. The axle 28, 32 may also travel through the clearance hole 82 without coming into contact with the swiveling back plate 80.

Figure 5:
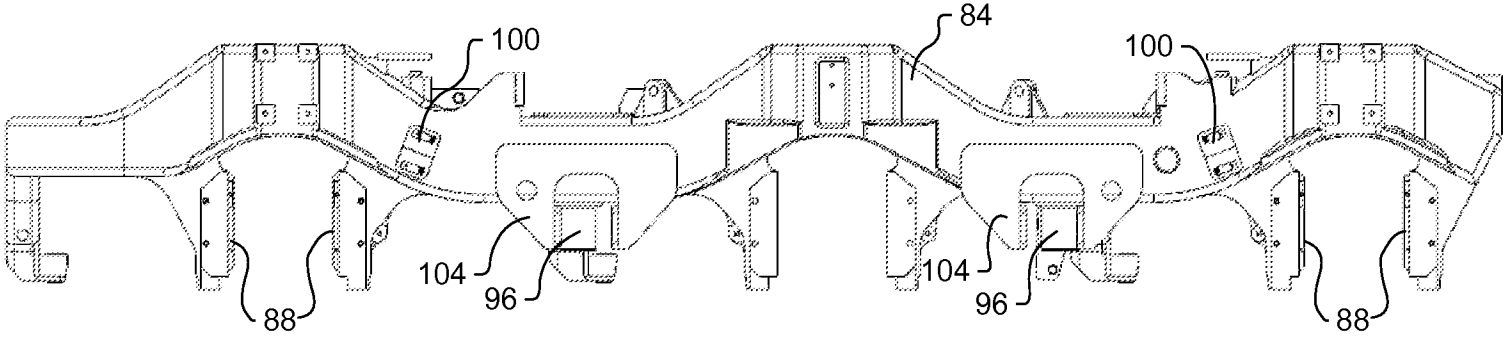
FIG. 5 is a side view of a side frame constructed in accordance with the present disclosure.
Figure 6:
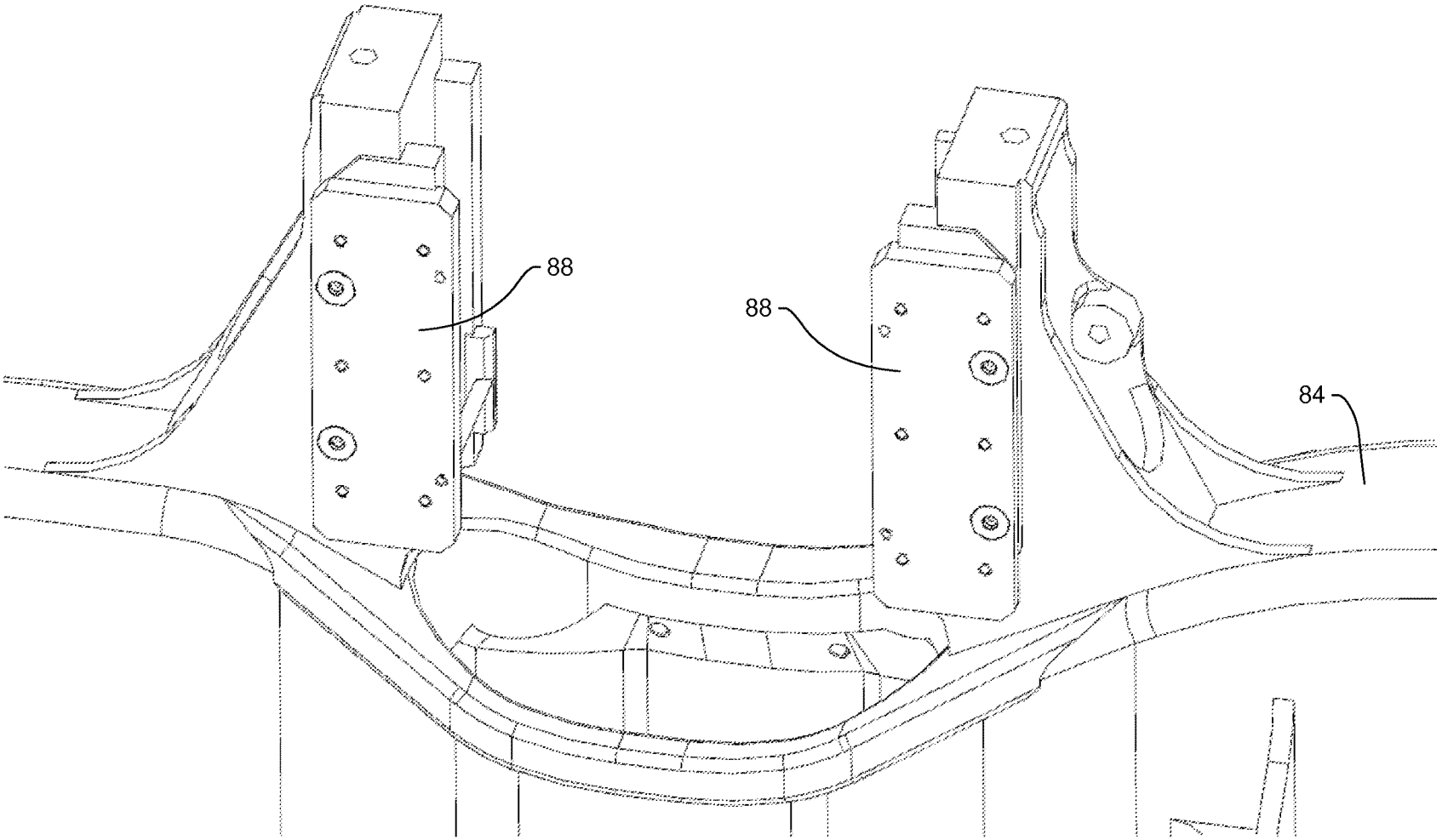
FIG. 6 is a perspective view of the side frame of FIG. 5 constructed in accordance with the present disclosure.

A side frame 84 of frame 40 is shown in FIGS. 5 and 6. In particular, the side frame 84 includes a pair of pedestal pads 88, a bellcrank post 96, a yaw damper bracket 100 and a bellcrank bumper stop bracket 104. The bellcrank 52 may rotate about the bellcrank post 96, while the yaw damper 64 may attach to the yaw damper bracket 100 and the traction rod 60. As the bellcrank 52 may include one or more bellcrank bumpers 68, the bellcrank bumper 68 may contact the bellcrank bumper stop bracket 104 as the bellcrank 52 rotates. The bellcrank bumper 68 may determine the rotational limit of the bellcrank 52 in a particular direction as it contacts the bellcrank bumper stop bracket 104.

Figure 7:
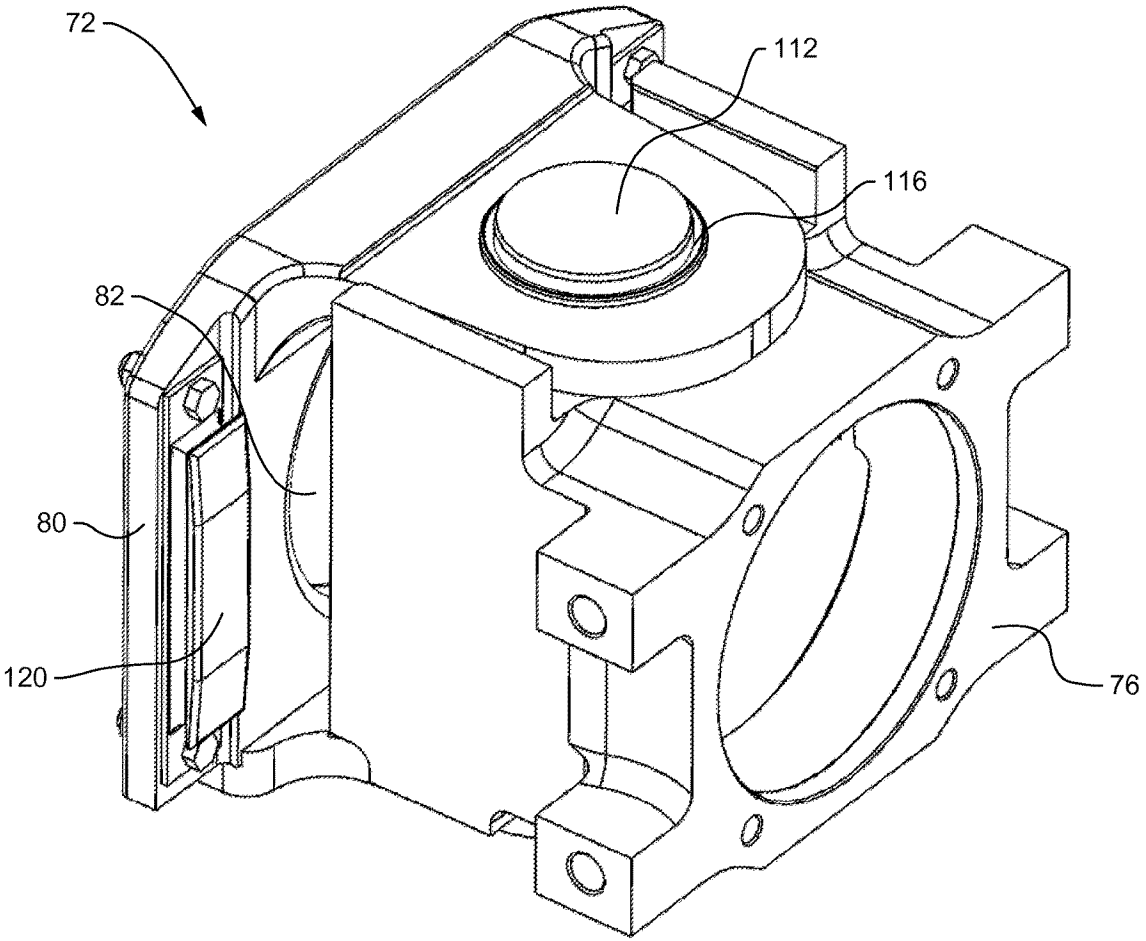
FIG. 7 is a perspective view of a bearing adapter assembly constructed in accordance with the present disclosure.
Figure 8:
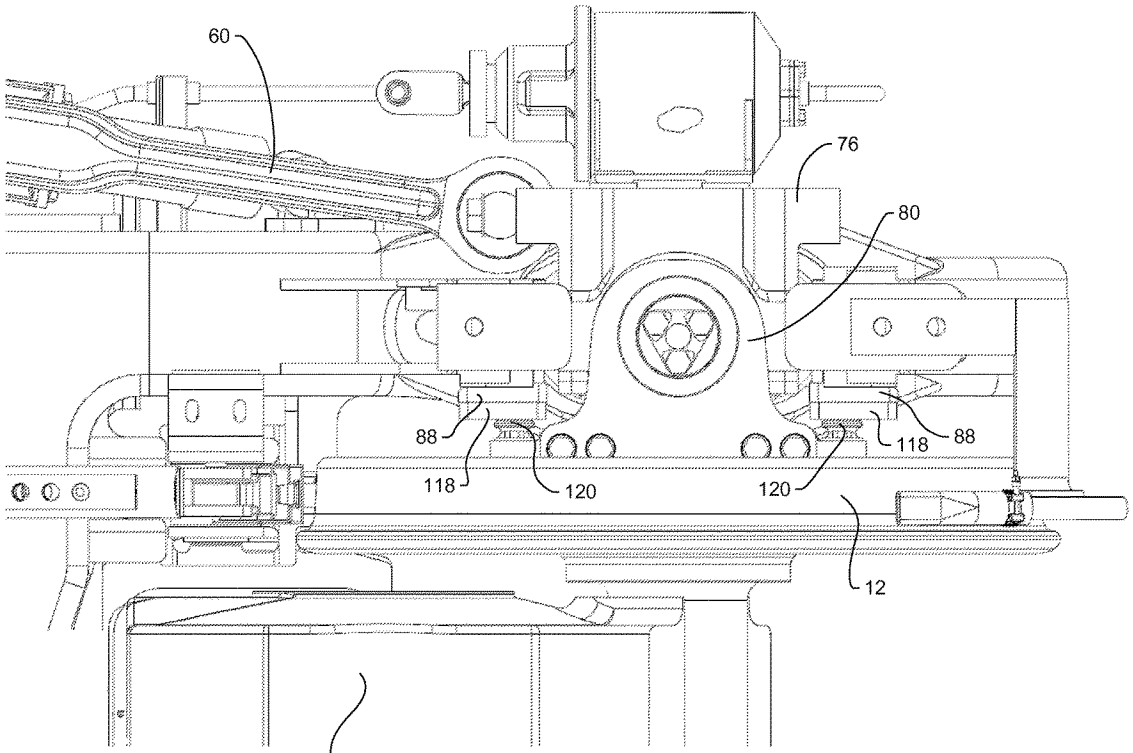
FIG. 8 is a bottom view of the bearing adapter assembly of FIG. 7 integrated with the truck of FIG. 3 according to the present disclosure.
Figure 9:
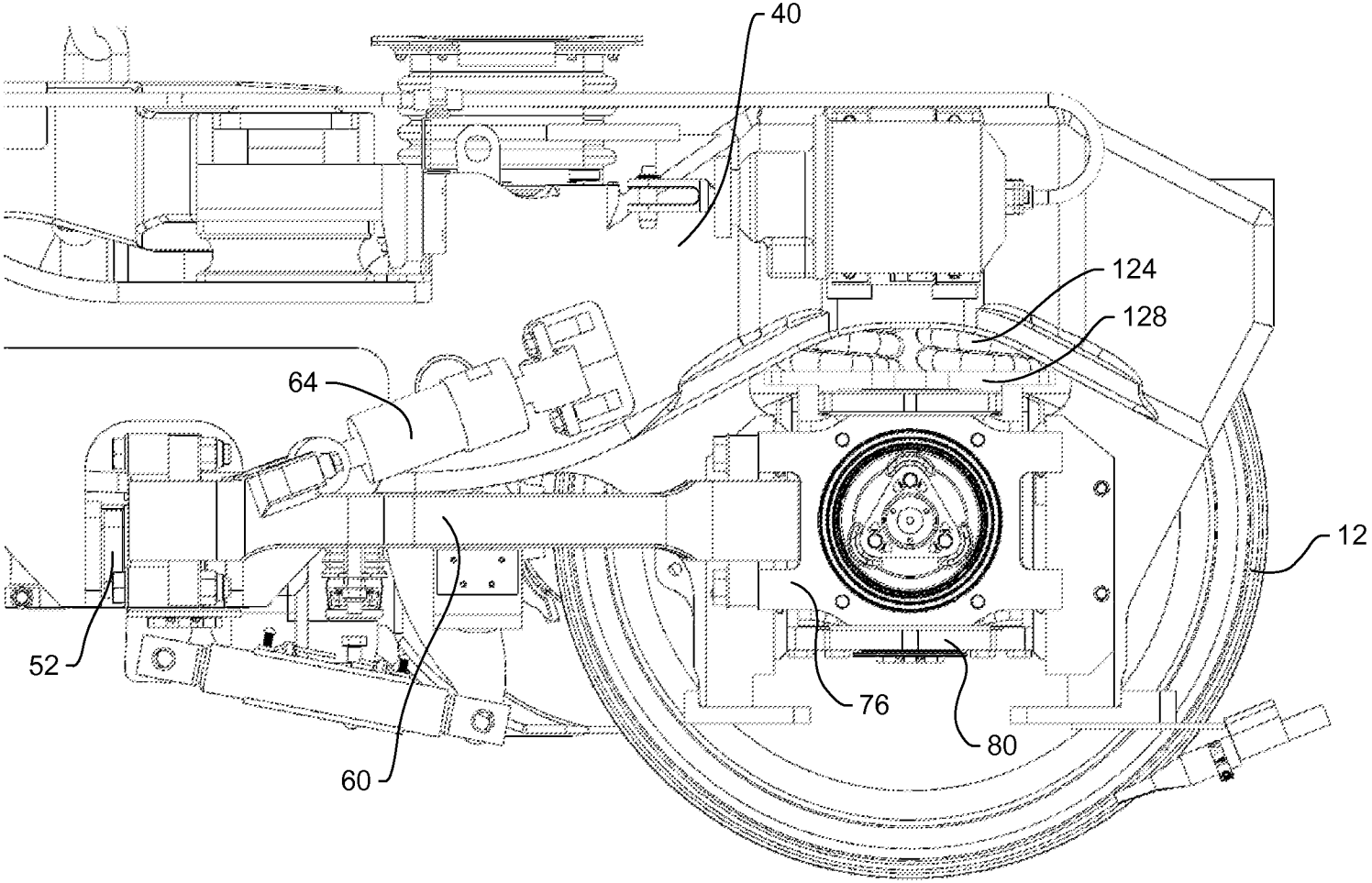
FIG. 9 is a side view of the bearing adapter assembly of FIG. 7 integrated with the truck of FIG. 3 according to the present disclosure.

Turning now to FIGS. 7-9, the bearing adapter assembly 72 is shown in greater detail. In particular, the bearing adapter 76 and swiveling back plate 80 may be rotatably connected by a pin 112. The pin 112 may be a part of the bearing adapter 76. Additionally, a wear liner 116 may be disposed between the bearing adapter 76 and swiveling back plate 80.

As best seen in FIGS. 8 and 9, the traction rod 60 may pivotably connect with the bearing adapter 76. This arrangement will be described in further detail below. A wear plate 118 may be attached to the pedestal pad 88 and a lateral thrust pad 120 may be attached to the swiveling back plate 80. Further, the truck 20 may be suspended over the axles 28, 32, 36 by one or more suspension springs 124, which may mount to the bearing adapter 76 via a spring seat 128.

In operation, the locomotive 10 may travel around a curved section of track. The trucks 20 may pivot accordingly. The disclosed steering system 48 allows the first and secondary axles 28, 32 to yaw relative to the truck 20 while the one or more intermediate axles 36 do not yaw relative to the truck 20. More specifically, the steering system 48 and mechanical linkage 50 may enable the first and secondary axles 28, 32 to yaw by equal degrees in opposite directions. In terms of the steering system 48, the mechanical linkage 50 may enable each bearing adapter 76 to rotate by the same degree, and in the same direction, relative to each respective swiveling back plate 80. Further, the mechanical linkage 50 may enable each bearing adapter 76 to longitudinally translate in opposite directions, and by the same degree, relative to each respective swiveling back plate 80. How the steering system 48 enables these properties will now be described.

As mentioned, the bearing adapters 76 may be disposed around the first and secondary axles 28, 32. The bearing adapters 76 may also provide for the rotation of a respective axle 28, 32 and may yaw, or pivot, with the axles 28, 32. In this manner, the yaw angle of the axle 28, 32 may equal the rotational degree of an associated bearing adapter 76.

The bearing adapter 76 may be pivotably connected to the traction rod 60, as best shown in FIGS. 4, 8 and 9. In this arrangement, a longitudinal movement of the traction rod 60 may correspond with a rotational movement of the bearing adapter 76. As the traction rod 60 moves in a longitudinal direction, the bellcrank 52, attached to an end of the traction rod 60, may rotate about the bellcrank post 96. As the bellcrank 52 rotates, the other end of the bellcrank 52 may cause a lateral motion in the connected crosslink 56. The opposite crosslink 56 end may correspond with a rotation in another bellcrank 52, which may correlate with a longitudinal traction rod 60 movement in another traction rod 60 and further with a rotational motion in another bearing adapter 76, in the same manner as described above. In this manner, a given rotational degree of one bearing adapter 76 may coincide with a rotation of equal degree and direction in a corresponding bearing adapter 76.

A longitudinal translation of corresponding bearing adapters 76, which may be necessary to accommodate axle 28, 32 yaw, may also be achieved through the disclosed steering system 48. When a traction rod 60 moves in a first longitudinal direction, the above-described process may cause a corresponding traction rod 60 movement in the opposite longitudinal direction. Further, a longitudinal traction rod 60 movement in a first direction will correspond to a connected bearing adapter 76 longitudinal movement in the same first direction, as the traction rod 60 and corresponding bearing adapter 76 are pivotably connected. Accordingly, through the steering system 48 and mechanical linkage 50, a longitudinal movement of one bearing adapter 76 in a first direction may coincide with a longitudinal movement of equal degree and opposite longitudinal direction of a corresponding bearing adapter 76.

While the bearing adapters 76 may rotate, as described above, they may also rotate relative to a pivotably attached swiveling back plate 80. As best shown in FIGS. 7 and 8, each swiveling back plate 80 may include one or more lateral thrust pads 120. These lateral thrust pads 120 may align laterally with wear plates 118 that attach to pedestal pads 88. In the event of lateral axle 28, 32 motion, the bearing adapters 76 may be drawn in the same lateral direction and may further draw the corresponding swiveling back plate 80 in that same direction. This lateral motion may be stopped when the lateral thrust pad 120 contacts the wear plate 118, thus limiting the lateral motion of the axle 28, 32.

Further, given appropriate clearances between the lateral thrust pad 120 and the wear plate 118, the swiveling back plate 80 may remain oriented within a rotational range relative to the truck 20. This range may keep the swiveling back plate 80 substantially aligned with the orientation of the truck 20. The lateral thrust pad 120 and wear plate 118 may be constructed of nylon, another polymer, a metal or a metal alloy. The clearance hole 82 may allow the axle 28, 32 to pass through the swiveling back plate 80 for the full range of motion allowed by the steering system 48. In this manner, lateral axle 28, 32 movements may be restricted while the bearing adapter 76, and thus the axle 28, 32, is free to yaw.

The yaw dampers 64 may be used to dampen yaw, or other motion, of the axles 28, 32 or other members of the mechanical linkage 50. This damping may be effective beyond the maximum operating speed of the locomotive 10.

Additionally, as the bellcranks 52 rotate due to axle 28, 32 yaw, the one or more bellcrank bumpers 68 may define rotational limits of the bellcranks 52, and thus the yaw degree of the axle 28, 32 as the traction rod 60 connects to both the bellcrank 52 and the bearing adapter 76. This may be accomplished by contact between the bellcrank bumper 68 and the bellcrank bumper stop bracket 104. Further, the bellcrank bumper 68 may progressively increase resistance to bellcrank 52 rotation, and thus bearing adapter 76 rotation, as the bellcrank bumper 68 compresses against the bellcrank bumper stop bracket 104. The bellcrank bumper 68 may be constructed of a polymer, or other wearing or compressible material. Additionally, each bellcrank 52 may also have two bellcrank bumpers 68, to limit bellcrank 52 and bearing adapter 76 rotation in two directions, as each bellcrank bumper 68 contacts the bellcrank bumper stop bracket 104.

The steering system 48 may be constructed around the first axle 28. Alternatively, the steering system 48 may incorporate a first and a secondary axle 28, 32. In such an embodiment, as shown, in FIGS. 3 and 4, the steering system 48 components used with the secondary axle 32 may include the same components as those used in conjunction with the first axle 28, but each component may be referred to as a secondary component. For example, each bearing adapter assembly 72 used in conjunction with the secondary axle 32 may be referred to as a secondary bearing adapter assembly.

Additionally, the steering system 48 may be used to retrofit trucks 20 to a configuration that allows axle 28, 32 yaw. In such a case, the steering system 48 may be attached to a traditional locomotive truck having pedestals and multiple axles 28, 32 that maintain the same yaw angle as the truck 20 negotiates a curved track section. After the addition of the steering system 48, the traditional locomotive truck may now allow axle 28, 32 yaw. Alternatively, the steering system 48 may be incorporated into the construction of a new truck 20. Employing the disclosed steering system 48 may increase locomotive 10 traction and decrease costs associated with new or upgraded locomotives 10.

INDUSTRIAL APPLICABILITY

In operation, the present disclosure sets forth a steering system which can find industrial applicability in a variety of settings. For example, the disclosure may be advantageously employed in the operation of locomotives, or other vehicles. More specifically, the disclosed steering system allows the first and secondary axles to yaw relative to the truck while one or more intermediate axles do not yaw relative to the truck.

Figure 10:
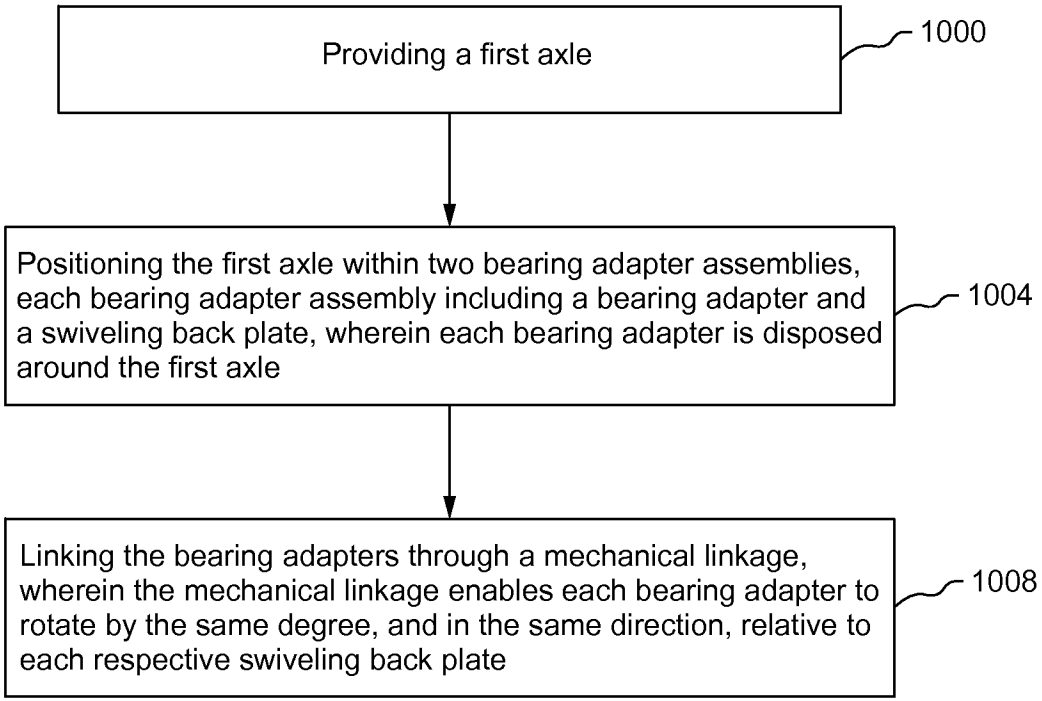
FIG. 10 is a flowchart depicting a sample sequence of actions which may be practiced in an embodiment of the present disclosure.

A method for radially steering a first axle of a locomotive truck can best be understood by referencing the flowchart in FIG. 10. The method may comprise providing a first axle, as shown in step 1000. The method may also include positioning the first axle within two bearing adapter assemblies, each bearing adapter assembly including a bearing adapter and a swiveling back plate, wherein each bearing adapter is disposed around the first axle, as shown in step 1004. Further, the method may also include linking the bearing adapters through a mechanical linkage, wherein the mechanical linkage enables each bearing adapter to rotate by the same degree, and in the same direction, relative to each respective swiveling back plate, as shown in step 1008

The steering system and mechanical linkage may enable the first and secondary axles to yaw by equal degrees in opposite directions. In terms of the steering system, the mechanical linkage may enable each bearing adapter to rotate by the same degree, and in the same direction, relative to each respective swiveling back plate. Further, the mechanical linkage may enable each bearing adapter to longitudinally translate in opposite directions, and by the same degree, relative to each respective swiveling back plate. Further, this functionality is enabled by the use of a novel bearing adapter assembly including a bearing adapter and a swiveling back plate.

The steering system may provide axle yaw properties to traditional trucks as a retrofit. Alternatively, the steering system may be incorporated into the construction of new trucks. Employing the disclosed steering system may increase locomotive traction and decrease wheel wear and costs associated with new or upgraded locomotives by improved alignment of the wheels to the rails.

What is claimed is:

1. A steering system for a locomotive truck, comprising;

a first axle;

a plurality of primary bearing adapter assemblies, each bearing adapter assembly including a bearing adapter and a swiveling back plate, wherein each bearing adapter is disposed around the first axle; and a mechanical linkage between the plurality of primary bearing adapter assemblies, the mechanical linkage includes a bellcrank, wherein the bellcrank includes a bellcrank bumper that progressively increases resistance to bearing adapter rotation as the bellcrank bumper compresses against a bellcrank bumper stop bracket.

2. The steering system of claim 1, wherein the mechanical linkage enables each bearing adapter to rotate by the same degree, and in the same direction, relative to each respective swiveling back plate.

3. The steering system of claim 2, wherein the mechanical linkage enables each bearing adapter to longitudinally translate in opposite directions, and by the same degree, relative to each respective swiveling back plate.

4. The steering system of claim 1, wherein the mechanical linkage includes a yaw damper.

5. The steering system of claim 1, wherein the locomotive truck steering system is attached to the locomotive truck, the locomotive truck configured with pedestals and multiple axles that maintain the same yaw angle as the locomotive truck negotiates a curved track section.

6. The steering system of claim 1, wherein the locomotive truck includes a plurality of secondary bearing adapter assemblies, each secondary bearing adapter assembly including a secondary bearing adapter and a secondary swiveling back plate, wherein each secondary bearing adapter is disposed around a secondary axle.

7. The steering system of claim 1, wherein the locomotive truck includes one or more intermediate axles disposed between the first and secondary axles.

8. A locomotive truck, comprising:

a frame;

a first axle supported by the frame; and a plurality of primary bearing adapter assemblies, each primary bearing adapter assembly including a bearing adapter and a swiveling back plate, wherein each bearing adapter is disposed around the first axle; and a mechanical linkage between the plurality of primary bearing adapter assemblies, the mechanical linkage includes a bellcrank, wherein the bellcrank includes a bellcrank bumper that progressively increases resistance to bearing adapter rotation as the bellcrank bumper compresses against a bellcrank bumper stop bracket.

9. The locomotive truck of claim 8, wherein the mechanical linkage enables each bearing adapter to rotate by the same degree, and in the same direction, relative to each respective swiveling back plate.

10. The locomotive truck of claim 9, wherein the mechanical linkage enables each bearing adapter to longitudinally translate in opposite directions, and by the same degree, relative to each respective swiveling back plate.

11. The locomotive truck of claim 8, wherein the locomotive truck includes pedestal pads.

12. The locomotive truck of claim 8, wherein the locomotive truck includes a plurality of secondary bearing adapter assemblies, each secondary bearing adapter assembly including a secondary bearing adapter and a secondary swiveling back plate, wherein each secondary bearing adapter is disposed around a secondary axle.

13. The locomotive truck of claim 8, wherein the locomotive truck includes one or more intermediate axles disposed between the first and secondary axles.

* * * * *